US005080754A

United States Patent [19]

Francis et al.

[11] Patent Number: 5,080,754

[45] Date of Patent: Jan. 14, 1992

[54] METHOD FOR REDUCING BRIGHTNESS REVERSION IN LIGNIN-CONTAINING PULPS AND ARTICLE OF MANUFACTURE THEREOF

[75] Inventors: Raymond C. Francis, DeWitt; Carlton W. Dence, Syracuse; Thomas C. Alexander, Clay, all of N.Y.

[73] Assignee: The Research Foundation of State University of NY, Albany, N.Y.

[21] Appl. No.: 557,153

[22] Filed: Jul. 20, 1990

[51] Int. Cl.[5] ..... D21C 9/00

[52] U.S. Cl. ..... 162/9; 162/72; 162/76; 162/150; 162/157.6; 162/158; 162/160; 162/181.2

[58] Field of Search ..... 162/150, 158, 160, 166, 162/76, 72, 9, 157.6, 135, 181.2

[56] References Cited

U.S. PATENT DOCUMENTS

| | | | |
|---|---|---|---|
| 2,005,378 | 6/1935 | Kiel | 162/160 |
| 2,285,490 | 6/1942 | Broderick | 162/158 |
| 2,622,960 | 12/1952 | Woods | 162/158 |
| 3,069,311 | 12/1962 | Harpham et al. | 162/157.6 |
| 3,723,425 | 3/1973 | Ackermann et al. | 260/240 B |
| 3,870,544 | 3/1975 | Shisko | 117/60 |
| 3,959,570 | 5/1976 | Jacquelin et al. | 162/126 |
| 4,124,439 | 11/1978 | Dessauer | 162/166 |
| 4,204,055 | 5/1980 | Lesas et al. | 162/157.6 |
| 4,871,423 | 10/1989 | Grimsley et al. | 162/160 |
| 4,904,342 | 2/1990 | Arnoldy et al. | 162/76 |

FOREIGN PATENT DOCUMENTS

| | | | |
|---|---|---|---|
| 0280332 | 8/1988 | European Pat. Off. . | |
| 2026963 | 10/1970 | Fed. Rep. of Germany | 162/158 |

*Primary Examiner*—Peter Chin

*Attorney, Agent, or Firm*—Heslin & Rothenberg

[57] ABSTRACT

A method and article of manufacture thereof is provided for reducing brightness reversion in bleached lignin-containing pulps or newsprint by the treatment of the bleached lignin-containing pulp or newsprint with a compound which donates a hydrogen atom to a photo-excited group or free radical more easily than does the lignin contained in the treated pulp. The hydrogen donating compounds include compounds with certain formyl functionality, including formate salts such as sodium, magnesium and calcium formate, formamides, formic acid esters, and formylurea. In one embodiment, calcium carbonate is added to enhance the activity of the formyl compound. The further addition of a trace amount of superoxide anion quencher such as copper sulfate or ascorbic acid is also provided to still further enhance the activity of the formyl compound, especially formate salts.

21 Claims, 1 Drawing Sheet

METHOD FOR REDUCING BRIGHTNESS REVERSION IN LIGNIN-CONTAINING PULPS AND ARTICLE OF MANUFACTURE THEREOF

BACKGROUND OF THE INVENTION

I. Field of the Invention

This invention relates to the field of paper manufacturing and, more particularly, to maintaining the brightness of bleached pulps or paper containing lignin. Maintaining brightness is also known in the industry as retarding or reducing brightness reversion.

II. Description of the Prior Art

Paper or pulps which contain lignin or ligno-cellulose have historically been bleached and continue to be bleached to obtain whiteness. The major drawback of bleached lignin-containing pulps is that they are easily and extensively darkened by light irradiation. This limits their use in various grades of printing papers.

Paper or pulp used in making newsprint is generally not bleached. If it is bleached, it is relatively mildly bleached as compared to higher quality paper. Therefore, such unbleached or mildly bleached pulps have a darker quality than bleached pulps. Newsprint has a relatively high lignin content and, therefore, has a tendency to become even darker when exposed to light. The invention can be used to prevent darkening of all types of lignin-containing pulps including bleached and unbleached pulps, such as newsprint.

The whiteness of paper is estimated by brightness measurements which are based on the reflectance of light having an average wavelength of 457 nm. An Elrepho brightness meter is one type of the instrument used to measure paper brightness. A low brightness (40% Elrepho) indicates brown or dark paper, while 90% Elrepho typifies white paper. Lignin-rich pulps have brightness values in the range of 50–70% Elrepho, depending on the wood species used and the pulping process. These pulps can be bleached to 70–90% brightness using known brighteners such as hydrogen peroxide, sodium borohydride or sodium dithionite. Hydrogen peroxide is normally used when a brightness of more than 70% is required. A problem associated with bleached lignin-rich pulps is that they may darken by as much as 20 Elrepho points when exposed to natural sunlight during exposure over a period of only one day.

Several methods are presently known to decrease brightness reversion in pulps containing lignin. The disadvantage of these methods is that they add significantly to the cost of the paper manufacturing process and are less effective than the invention.

One known method described in European Patent No. 0 280 332 (Agnemo et al.) consists of serial treatments to reduce the carbonyl groups (photosensitizers) contained in the pulp to alcohol groups. In addition, the process includes alkylation of the phenolic hydroxyl groups in the lignin, from which hydrogen atoms are abstracted, by the use of an alkaline propylene oxide. Addition of fluorescent compounds that absorb or reflect the ultraviolet light which would otherwise excite photosensitizer groups is also disclosed.

There has not been any method taught in the prior art in which additives were specifically selected for their ability to donate hydrogen atoms to reactive chemicals present in the bleached pulp upon exposure to light.

Formic acid, which is a formyl compound, has been used as a catalyst in the brightening process of organic materials (i.e., U.S. Pat. No. 3,723,425, Ackermann et al.). However, formic acid should not be used to retard brightness reversion because of its acidity which is known to accelerate brightness reversion due to light irradiation (Lee et al., J. Amer. Inst. Conserv. 28:1 (1989)).

Of the known processes for maintaining brightness or reducing brightness reversion, none have the capacity to reduce brightness reversion as effectively as the invention, while at the same time minimizing the additional cost of production of the paper. Of the known processes, none is available at a low cost and none has outstanding whiteness stabilization qualities. A need thus persists for an efficient and low cost paper manufacturing process which reduces the brightness reversion of bleached pulps containing lignin.

SUMMARY OF THE INVENTION

This need is satisfied and the shortcomings of the prior art are overcome, in accordance with the principles of the present invention.

The present invention discloses that certain formyl compounds, which are good hydrogen donors, can be added to the papermaking process to retard brightness reversion.

The claimed method for reducing brightness reversion in bleached pulps containing lignin comprises the steps of forming said pulps into a paper sheet and treating said paper sheet with a compound having formyl functionality. It is believed that formyl compounds donate a hydrogen atom to a photo-excited group or free radical more easily than lignin donates a hydrogen atom to the same photo-excited group or free radical. The photo-excited group is created by light irradiation of the paper and may react in such a way as to generate free radicals.

The compounds which can be used as good hydrogen donors are those compounds with a hydrogen bond which is weaker than the hydrogen bond of the lignocellulose complex but which are not too strongly acidic. Good hydrogen donating compounds, such as those with a certain type of formyl functionality, include formate salts, formamides, formic acid esters and n-formylurea. These compounds are best described by FIG. I below,

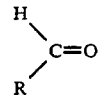

FIG. I wherein O is oxygen, C is carbon, H is hydrogen and R is any functional group having an element bonded to C, said element being selected from the group consisting of nitrogen and oxygen. If a strong acidic formyl compound is used, it should first be converted to a metal salt or formyl ester before application to the pulp.

The method of use of the formyl compound is enhanced by adding calcium carbonate to the surface of the paper. In particular, the addition of calcium carbonate to assist formate salts has shown good results in reducing brightness reversion. Trace amounts of a superoxide anion quencher such as copper sulfate or ascorbic acid are also used to assist the formate salts (i.e., sodium formate, calcium formate, magnesium formate) in stabilizing pulp brightness.

Accordingly, it is a principal object of this invention to improve the paper manufacturing process and quality of paper produced therefrom as compared to the presently known processes and products.

One significant advantage of this invention is the reduction of brightness reversion in lignin-containing pulps.

Another advantage of this invention is the low cost of manufacturing better quality paper. The cost of manufacturing paper according to this invention is only slightly higher than the cost of manufacturing untreated paper. However, the invention provides a dramatic increase in the brightness stabilization of lignin-containing paper.

A further advantage of this invention is that the compounds used to treat the paper are known to be environmentally safe, and inexpensive.

Yet another advantage of this invention is that it reduces the quantity of wood needed to make good quality paper because it provides the opportunity for expanding the use of mechanical pulps which can be obtained from wood in significantly higher yields than other pulps. Increasing the use of mechanical and other lignin-containing pulps will produce more paper from fewer logs. Also, the addition of brightness stabilization compounds adds greater mass to the paper at a cost less than the cost of the same amount by weight of pulp.

A still further advantage of this invention is that the presently known paper manufacturing processes do not need to be significantly altered in order to incorporate the invention. Known methods of production require only a modification in the form of an additional step to treat the paper sheet with the brightness stabilizing compounds.

DETAILED DESCRIPTION

Figure 1:
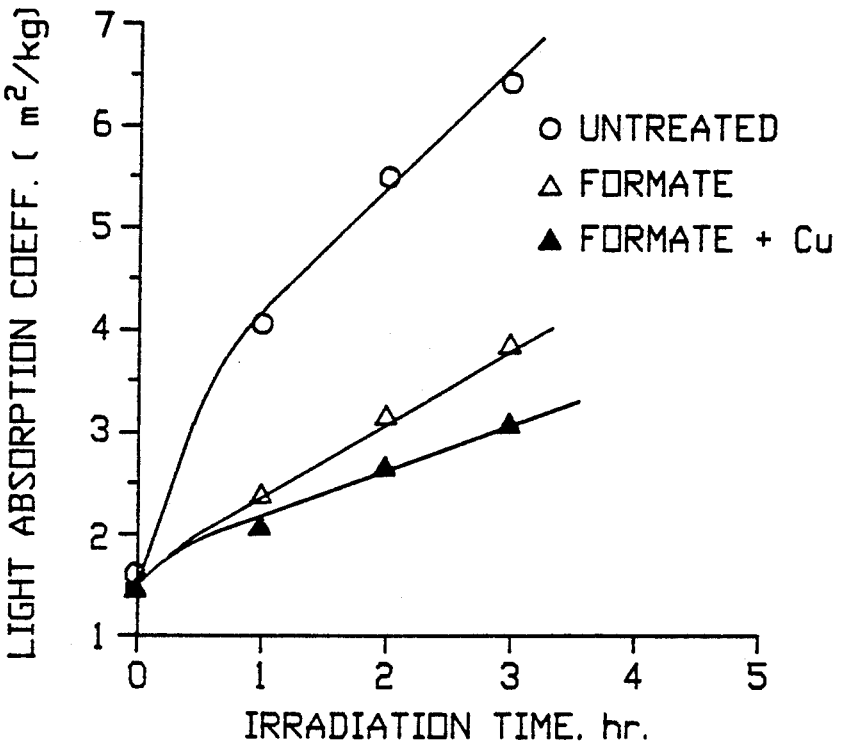
FIG. 1 shows the effect of formate and $CuSO_4$ or preventing yellowing of lignin-containing pulps.

Pulps or paper are generally divided into two main classes being either "chemical" pulps or "mechanical" pulps. The classification of the pulps is determined by the manner in which the pulps are made from wood. Presently, more chemical pulps are manufactured than mechanical pulps.

In producing chemical pulps, a chemical treatment is used to dissolve the lignin from the wood. In these processes, most of the hemicelluloses are dissolved. Thus, the pulp yield for a chemical pulping process is typically 40%-50% of the wood. Mechanical pulping processes produce more paper per unit of wood, with typical yields being higher than 85%. Therefore, chemical pulps are characterized by lower yield and lower lignin content.

Mechanical pulps, however, are characterized by their higher yield of pulp and higher lignin content. Mechanical pulps require a significant amount of mechanical energy such as grinding to break down wood chips made from the wood. There are different subclasses of mechanical pulps. Groundwood (GW) and pressurized groundwood (PGW) are generally manufactured by pressing wood bolts against a revolving grinder wheel. Refiner mechanical pulps (RMP) are made in disc refiners under ambient pressure and a temperature of approximately 100° C. Thermomechanical pulp (TMP) are made in a process using high pressure steam to elevate the temperature and, thus, soften the lignin making the fibers easier to separate. Chemithermomechanical pulps (CTMP) and thermochemimechanical pulps (TCMP) are made in a process which usually involves lignin sulfonation and high temperature treatments to soften the chips. Chemimechanical pulps (CMP) use a chemical treatment only and do not employ a thermal treatment.

The chemical class of pulps do contain some lignin, generally less than 5 weight percent as compared to more than 20% for mechanical pulps. The lignin in chemical pulps is completely removed after a multistage bleaching process is applied to achieve 90% brightness. However, semi-bleached chemical pulps are not free of lignin. Therefore, certain lignin-containing pulps fall into the chemical class as well.

In addition to the chemical and mechanical pulps, there is a quasi category of pulps known as "semi-chemical". These pulps are hybrids of mechanical and chemical pulps in that they have higher yields than the chemical pulps (i.e., 50%-85% yield). However, the lignin content is higher than with chemical pulps, and lower than the lignin content of mechanical pulps.

The major drawback to mechanical pulps, semi-chemical pulps, and chemical pulps which are not fully bleached is that they contain lignin which, when irradiated by light, can darken extensively. This limits the use of lignin-containing pulps in various grades of quality printing papers.

During the manufacturing process of paper, the wood chips are broken apart by one of the above methods and the fibers are dispersed in water to form a slurry. The slurry is often bleached or whitened by known processes. The type of bleaching or whitening process used in the manufacturing of bleached lignin-containing pulp may be selected by the manufacture from any of the standard known processes used to obtain the desired brightness for said pulp. If the lignin-containing pulp is not bleached or mildly bleached, it will usually be used as newsprint and will have a darker quality. The pulp is bleached in a blend chest, bleaching tower or similar vessel. It is then transferred to a papermaking machine. The slurry is spread over a sheet-like or planar surface. Water is removed by filtration, and the slurry is pressed into a sheet of the desired thickness. The sheets are then dried. The sheets can be categorized by their thickness type and are referred to as paper and/or pulp sheets.

The invention contemplates treating the pulp with a brightness-maintaining compound or compounds just prior to or during the process step where the pulp slurry is engaged in the papermaking machine, and subsequent to any bleaching process, if such bleaching is employed.

The treatment of the paper sheet can take the form of dipping the sheet in a solution of the brightness stabilizing compound(s) coating one or both sides with the compound, or applying or spraying the compound in a solution or solid form onto the sheet surface.

It is believed that the lignin-containing pulp is darkened by sunlight or other irradiating light due to the presence of a photo-excited group within the lignin. This photo-excited group, or free radical generated by it, is believed to abstract a hydrogen atom from the lignin to form a lignin radical. The lignin radical, in turn, reacts with oxygen. The lignin radical plus oxygen forms colored materials. It is believed that these colored materials contribute to the darkening of the paper.

Therefore, the invention comprises a method of manufacturing paper and article of manufacture thereof with reduced brightness reversion qualities whereby the lignin-containing paper or pulp sheet is treated with compounds that are believed to donate a hydrogen atom to the photo-excited group or free radical more easily than the lignin complex. The photo-excited group or free radical is created by irradiating said sheet with artificial or natural light. Compounds which are included in the category of being good hydrogen donors are those compounds containing the formyl functionality. Of the type:

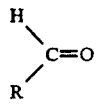

wherein O is oxygen, C is carbon, H is hydrogen, and R is any functional group having an element bonded to C, said element being selected from the group consisting of nitrogen and oxygen. The compounds which satisfy this class include sodium formate, calcium formate, magnesium formate, formic acid esters such as hexyl formate, formamides such as N,N-dibutylformamide N-formylurea, etc. Compounds with a very strong acidity (such as formic acid) should be converted to a metal salt (such as sodium formate), or a formyl ester, before application in the inventive process.

A 1985 survey conducted by the Canadian Center for Occupational Health and Safety found no evidence to indicate that sodium or calcium formate is toxic. These compounds are non-volatile with a melting point of more than 250° C. They are also unreactive toward ground state oxygen and, consequently, have been used for flame proofing of fibrous materials used in gypsum board (Japan Patent No. 77-74,615—Kokai). Sodium and calcium formates are considerably low in cost and are, at this writing, cheaper than the bleached CTMP to which they might be added.

The amount of formyl compound to be used to coat or treat this sheet is dependent upon the desired effect the manufacturer wishes to obtain. A thicker coating generally will have a greater effect than a thin coating of the same uniformity. However, even a very light treatment of formyl compound will have effect on brightness reversion. It is up to the manufacturer of the papermaking process to determine what percentage by weight of the formyl compound should comprise of the paper sheet. Any percent greater than 0% by weight would have some effect on brightness reversion. The degree of brightness reversion reduction will be determined by the extent of the coating.

Calcium carbonate will increase the hydrophobicity of the sheet surface. This should enhance precipitation of the formate salt on the paper surface. A higher concentration of formate salt on the paper surface should enhance its ability to prevent brightness reversion. The carbonate also might participate in beneficial free radical reactions as discussed and shown below.

A formate salt such as sodium formate probably reduces light reversion by the following reactions:

$HCO_2^- \rightarrow CO_2.^- + H.$

The $CO_2^-$ radical is believed to react with $O_2$ as shown below.

$CO_2.^- + O_2 \rightarrow CO_2 + O_2.^-$ $K = 2.4 \times 10^9$ L/mole.s

In addition to the use of small amounts of calcium carbonate to increase the effectiveness of formate salts, trace amounts of a superoxide anion quencher (less than 0.5 weight percent) such as, copper sulfate or ascorbic acid is used in conjunction with formate salt to treat the paper sheet to reduce the darkening of the lignin-containing pulps. The results of examples using the combination of formate salt and the superoxide anion quencher showed a synergistic effect on the reduction of brightness reversion. Ascorbic acid (0.1% on pulp) when used on lignin-containing pulps by itself had absolutely no effect on reversion. The copper sulfate when used on lignin-containing pulps alone actually increased the rate of yellowing.

The superoxide anion ($O_2.^-$ is a free radical and probably contributes to yellowing. When the carbonate is added to the pulp, there then is a trace amount of $HCO_3^-$ in the solution associated with the paper or pulp. The bicarbonate anion might then convert the superoxide anion to oxygen by the reactions below.

$HCO_3^- \rightarrow CO_3.^- + H.$ $CO_3.^- + O_2.^- \rightarrow CO_3^{-2} + O_2$ $K = 4 \times 10^8$ L/mole.s It is believed that the $Cu^{++}$ cation from the copper sulfate oxidizes the superoxide anion to oxygen even better than the bicarbonate anion as shown below. The copper cation is known as a superoxide anion quencher.

$Cu^{++} + O_2.^- \rightarrow Cu^+ + O_2$ $K = 5 \times 10^9$ L/mole.s

The copper cation may also react with some of the formate to form copper formate which has a rate constant of $3 \times 10^8$ L/mole.s for reactions with the superoxide anion. Other superoxide anion quenchers which could assist in trapping the superoxide anion include manganese (II) compounds.

The following examples are given with the results obtained to illustrate the activity of the hydrogen-donating compounds. Illustrations using calcium carbonate, copper sulfate and ascorbic acid are also provided.

In all of the examples set forth below, the light-aging process was accelerated by placing pulp sheets (relatively thick), or paper sheets (relatively thin) close to a high intensity light source. The sheets were placed in water-cooled compartments approximately 4.5 inches from a 1,000 watt mercury-tungsten lamp which emitted light at wavelengths of more than 300 nm. The experiments were conducted such that only half of the sheet was reverted in the aging device. The other half of the sheet was reverted in natural sunlight.

EXAMPLE 1

A peroxide-bleached TMP pulp sheet of 74.5% Elrepho brightness was used. It was expected that this type of sheet would normally revert approximately 10 and 15 brightness points after one and three-hours, respectively, of exposure in the experimental light-aging device. A solution of sodium formate and water was prepared wherein the sodium formate was approximately 50% of the weight of the pulp. The sheet was submerged in the solution, removed, and allowed to dry. The sheet was then placed in the light-aging device and the initial brightness and the brightness after irradiation were measured. The formate-treated pulp reverted less than what was expected for non-treated pulp as indicated by Table I.

TABLE I

| | Bleached TMP | |
|---|---|---|
| | Treated With 50% Sodium Formate | Untreated |
| Initial Brightness, % | 74.7 | 74.7 |
| Brightness loss after 1 hour | 3.8 | 10.0 |

TABLE I-continued

| | Bleached TMP | |
|---|---|---|
| | Treated With 50% Sodium Formate | Untreated |
| Brightness loss after 3 hours | 7.3 | 15.0 |

EXAMPLE 2

TMP was made from Norway spruce which was bleached to 74.7% Elrepho brightness with hydrogen peroxide. Four 10-gram handsheets of pulp were made in a 15-cm diameter Büchner funnel and pressed to 40% consistency (i.e., 10-grams oven-dried pulp comprised of 25 grams of pulp plus water). Varying amounts of sodium formate were dissolved in 20 mL of water and added uniformly to the pulp sheet. The amounts of sodium formate used are described in Table II.

TABLE II

| | Sample | | | |
|---|---|---|---|---|
| | 1 | 2 | 3 | 4 |
| Initial Brightness, % | 74.7 | 75.3 | 75.4 | 75.4 |
| Brightness Loss (1 hour) | 12.1 | 11.7 | 9.5 | 6.8 |
| Brightness Loss (3 hours) | 16.0 | 15.6 | 13.4 | 9.9 |
| Final (3 h) Brightness, % | 58.7 | 59.7 | 62.0 | 65.5 |

Sample 1: Bleached TMP – untreated
Sample 2: Bleached TMP + 1.0% $NaHCO_2$
Sample 3: Bleached TMP + 5.0% $NaHCO_2$
Sample 4: Bleached TMP + 10.0% $NaHCO_2$ It can be seen from Table II that the bleached, untreated lignin-containing pulp had an initial brightness loss upon exposure to light. The first hour exposure resulted in a 12.1-point brightness loss. The addition of 10% sodium formate to the pulp resulted in a reversion of only 6.8 points after one-hour. It is further seen that even 1.0% sodium formate applied to the pulp gives a slight improvement in brightness stability as shown by Sample 2.

EXAMPLE 3

Example 3 illustrates that the formate addition is effective in conjunction with other standard known pulp modifications. The particular modification employed was the standard known alkylation of phenolic hydroxyl groups in the pulp. Accordingly, bleached TMP was alkylated with dimethyl sulfate and sodium hydroxide. The phenolic hydroxyl concentration was measured by aminolysis (Gellerstedt and Lindfors, Svensk Papperstid, 87 R115 [1984]) and by periodate oxidation in which methanol was formed. The results in Table III show that although alkylation reduced reversion by approximately 33%, when alkylation was combined with a formate addition of 10%, the results were a 58% decrease in reversion after one-hour of aging (Table III).

Thus, the invention is effective in reducing the brightness reversion of pulps which are manufactured in conjunction with other pulp modifications.

TABLE III

| | Sample | | |
|---|---|---|---|
| | 1 | 2 | 3 |
| Initial Brightness, % | 76.0 | 76.4 | 76.7 |
| Brightness Loss (1 hour) | 10.1 | 6.8 | 4.2 |
| Brightness Loss (3 hours) | 15.4 | 11.1 | 8.6 |
| Final (3 h) Brightness, % | 60.6 | 65.3 | 68.1 |
| Phenolic Hydroxyl Concentration, mole/g pulp | 0.16 | 0.02 | — |

Sample 1: Bleached TMP
Sample 2: Bleached TMP + Alkylation
Sample 3: Bleached TMP + Alkylation + 10% $NaHCO_2$

EXAMPLE 4

Bleached Norway spruce TMP was made from a different log than the pulps in Examples 1–3. The purpose of this example is to illustrate the beneficial effect of sodium formate with pulp when the formate concentrates on the surface of the sheets. Sample 1 in Table IV corresponds to the bleached TMP without any formate additive. Samples 2 and 3 correspond, respectively, to 5% and 10% sodium formate uniformly added to the pulp according to the process as described in Examples 1, 2, and 3. Samples 4 and 5 were prepared by pressing 10-gram handsheets to 40% consistency and adding 10%–20% ground sodium formate crystals to the surface of the sheet. The solid formate penetrated the sheet as it dried. As can be seen by comparing Samples 3 and 4, the use of 10% sodium formate as a solid resulted in only a slightly more effective reduction of reversion than did the same amount of formate distributed uniformly throughout the sheet. This indicates that the solid formate quickly dissolved on the sheet surface and then diffused through the sheet before it dried. It can be seen from the results illustrated in Table IV that 20% sodium formate applied to the pulp as a solid (and, therefore, the surface) decreased reversion from the untreated TMP value of 11.1 to 5.8 after one-hour of irradiation.

TABLE IV

| | Sample | | | | |
|---|---|---|---|---|---|
| | 1 | 2 | 3 | 4 | 5 |
| Initial Brightness, % | 73.3 | 73.7 | 74.1 | 73.6 | 73.7 |
| Brightness Loss (1 hour) | 11.1 | 10.6 | 8.6 | 8.1 | 5.8 |
| Brightness Loss (3 hours) | 15.7 | 15.4 | 13.8 | 12.5 | 9.4 |
| Final (3 h) Brightness, % | 57.6 | 58.3 | 60.3 | 61.1 | 64.3 |

Sample 1: Bleached TMP
Sample 2: Bleached TMP + 5% $NaHCO_2$ (solution)
Sample 3: Bleached TMP + 10% $NaHCO_2$ (solution)
Sample 4: Bleached TMP + 10% $NaHCO_2$ (solid)
Sample 5: Bleached TMP + 20% $NaHCO_2$ (solid)

EXAMPLE 5

A sample of CTMP, a stronger form of pulp than TMP, was used. Samples 1–5 in Table V were prepared similarly to the samples described in Table IV above.

Table V shows that when 10% sodium formate is added as a powder (Sample 4), it is slightly more effective in reducing brightness reversion than when it is added uniformly throughout (Sample 3). It can be seen that 20% sodium formate placed on the pulp surface decreases the reversion from 12.4 to 4.9 after one-hour of irradiation. This represents an approximate 60% decrease in brightness reversion.

TABLE V

| | Sample | | | | |
|---|---|---|---|---|---|
| | 1 | 2 | 3 | 4 | 5 |
| Initial Brightness, % | 74.1 | 73.9 | 74.4 | 74.2 | 74.3 |
| Brightness Loss (1 hour) | 12.4 | 11.9 | 9.7 | 7.2 | 4.9 |
| Brightness Loss (3 hours) | 19.6 | 18.0 | 15.3 | 13.5 | 9.8 |

TABLE V-continued

| | Sample | | | | |
|---|---|---|---|---|---|
| | 1 | 2 | 3 | 4 | 5 |
| Final (3 h) Brightness, % | 54.5 | 55.9 | 59.1 | 60.7 | 64.5 |

Sample 1: Bleached CTMP
Sample 2: Bleached CTMP + 5% $NaHCO_2$ (solution)
Sample 3: Bleached CTMP + 10% $NaHCO_2$ (solution)
Sample 4: Bleached CTMP + 10% $NaHCO_2$ (solid)
Sample 5: Bleached CTMP + 20% $NaHCO_2$ (solid)

EXAMPLE 6

Example 6 illustrates the effect of increasing the formate concentration on the sheet surface using calcium formate. Calcium formate is less soluble in water than sodium formate and, hence, should precipitate on the sheet surface more easily than sodium formate. Calcium formate powder in the amounts of 10% and 20% by weight based on pulp weight were sprinkled on the surface of bleached CTMP, Samples 2 and 3, respectively. The CTMP was the same as that used in Example 5 except that the CTMP of Example 5 had been bleached with a lower concentration of hydrogen peroxide than the pulps used in this Example. The calcium formate penetrated the sheet initially but then crystallized on the sheet surface upon drying The interaction between the calcium formate and the fibers did not subjectively seem as good as sodium formate. Table VI shows, however, that the addition of 20% calcium formate to the pulp surface decreased the reversion from 14.1 to 10.2 points after one-hour of irradiation.

TABLE VI

| | Sample | | |
|---|---|---|---|
| | 1 | 2 | 3 |
| Initial Brightness, % | 76.2 | 75.7 | 76.3 |
| Brightness Loss (1 hour) | 14.1 | 11.5 | 10.2 |
| Brightness Loss (3 hours) | 19.1 | 15.0 | 13.8 |
| Final (3 h) Brightness, % | 57.1 | 60.7 | 62.5 |

Sample 1: Bleached CTMP
Sample 2: Bleached CTMP + 10% Calcium formate (solid)
Sample 3: Bleached CTMP + 20% Calcium formate (solid)

EXAMPLE 7

Example 7 seeks to concentrate the formate compound on the surface of the pulp sheet. This was attempted by increasing the hydrophobic qualities of the pulp sheet surface prior to the sodium formate addition. A 10-gram pulp sheet was made and pressed in a 15-cm diameter Büchner funnel. 5% calcium carbonate (0.05 gram) was slurried on top of the sheet with the vacuum off. The sheet was de-watered under vacuum and pressed to 40% consistency in a pneumatic press. Sodium formate was ground and sprinkled on the surface of the sheets. Using this technique, it was not possible to produce a carbonate coating that was completely uniform. Therefore, four different runs using three different CTMP's were performed. In each run, the bleached carbonate-coated and the carbonate plus sodium formate coated sheets were reverted. The results are shown in Table VII and are typical for all four runs.

TABLE VII

| | Sample | | |
|---|---|---|---|
| | 1 | 2 | 3 |
| Initial Brightness, % | 73.5 | 75.3 | 74.4 |
| Brightness Loss (1 hour) | 14.6 | 10.9 | 6.1 |
| Brightness Loss (2 hours) | 18.3 | 14.1 | 8.8 |

TABLE VII-continued

| | Sample | | |
|---|---|---|---|
| | 1 | 2 | 3 |
| Brightness Loss (3 hours) | 20.5 | 15.4 | 10.1 |

Sample 1: Bleached CTMP
Sample 2: Bleached CTMP + 5% $CaCO_3$
Sample 3: Bleached CTMP + 5% $CaCO_3$ + 10% $NaHCO_2$ (solid)

After one-hour of irradiation, the reversion was 14.6 points for the bleached, untreated CTMP, 10.9 points for the pulp treated with carbonate alone, and only 6.1 points for the sheet coated with the carbonate and the formate. The three-hour reversion of the pulp treated with the carbonate and formate was significantly less than the one-hour reversion for the untreated, bleached pulp. After two-hours of artificial aging, the bleached sample reverted 18.3 points, while the bleached CTMP sheet coated with formate and carbonate reverted 8.8 points (see Table VII). This represents a 52% decrease in reversion.

The bleached, untreated CTMP reverted 19.2 points in natural daylight after eight-hours of irradiation, while the carbonate-coated sheet reverted only 16.6 points, and the carbonate plus formate coated sheet reverted only 11.1 points. (See Table VII(a)).

TABLE VII(a)

| | Sample | | |
|---|---|---|---|
| | 1 | 2 | 3 |
| Initial Brightness, % | 73.5 | 75.3 | 74.4 |
| Brightness Loss (8 hours) | 19.2 | 16.6 | 11.1 |
| Final (8 h) Brightness, % | 54.3 | 58.7 | 63.3 |
| Samples: Same as Table 6 | | | |
| Irradiated by Natural Daylight | | | |

| Temperature Conditions | | |
|---|---|---|
| 8:30 A.M. 4° C. | Dry Bulb 39° F. | Wet Bulb 34.2° F. |
| 10:30 A.M. 6° C. | Dry Bulb 42° F. | Wet Bulb 36.5° F. |
| 1:00 P.M. 13° C. | | |
| 2:30 P.M. 14° C. | | |
| 4:30 P.M. 15° C. | | |

EXAMPLE 8

Examples 1-7 were conducted on thick sheets (weight approximately 500 g/m$^2$) of pulp. However, in Example 8, thin sheets (60 g/m$^2$) were used. A standard-type draw down coater was used to coat the thin sheets made from a commercial bleached CTMP. To concentrate the coating on the paper surface, a concentrated solution of the calcium carbonate and sodium or calcium formate was required. Using a solution that consisted of 30% by weight calcium carbonate, 30% by weight sodium formate, and 40% by weight $H_2O$, a coated sheet of 83.9% brightness was produced (bleached pulp brightness, 75.8%). This pulp reverted only 2.0 points after three-hours in the light-aging device. However, the coating solution was of a viscous nature and, therefore, the coating charge was approximately two times the weight of the paper (both sides were coated).

To decrease the amount of hydrogen-donating compound coating the paper surface, a less concentrated solution was used. However, when less concentrated solutions were used, the additives quickly penetrated the sheet and "filled" the sheet rather than coating it, as desired. The limited brightness increase (typically less than 1 point) which was afforded by coating the surface in this manner indicates that penetration of the additive occurred. These filled or penetrated sheets showed a significant improvement in brightness stability as compared to untreated sheets. It appeared that when calcium carbonate was dissolved in formate solution, calcium formate was as effective as sodium formate. However, calcium formate offers an advantage over the sodium salt with regard to price stability in the marketplace. Both salts are made by reacting the corresponding hydroxide with carbon monoxide. Unlike sodium hydroxide, calcium hydroxide is generally inexpensive and readily available.

The supply of calcareous materials from which calcium oxide can be easily made appears unlimited. The results from the "filled" or penetrated sheets are shown in Table VIII.

TABLE VIII

| | Sample | | |
|---|---|---|---|
| | 1 | 2 | 3 |
| Initial Brightness, % | 75.8 | 76.4 | 76.2 |
| Brightness Loss (1 hour) | 7.8 | 5.6 | 2.9 |
| Brightness Loss (3 hours) | 13.9 | 10.4 | 5.5 |
| Final (3 h) Brightness, % | 61.9 | 66.0 | 70.7 |

Sample 1: Bleached CTMP
Sample 2: Bleached CTMP + 31% $CaCO_3$
Sample 3: Bleached CTMP + 43% $CaCO_3$ + 6% $Ca(HCO_2)_2$

EXAMPLE 9

Example 9 illustrates the synergistic effect of the addition of a superoxide anion quencher, such as copper sulfate.

Trace amounts of copper sulfate were added with the sodium formate to the pulp surface (50–100 ppm on pulp). $Cu^{++}$ oxidizes the superoxide anion which contributes to yellowing as follows:

$$Cu^{++} + O_2^- \rightarrow Cu^{++} + O_2$$

$$K = 5 \times 10^9 \text{ L/mole.s}$$

Solutions were made from sodium formate and from sodium formate and copper sulfate. These solutions were added uniformly to thin sheets made from bleached CTMP. The increase in light absorption coefficient measured at 457 nm versus time of light-aging is shown in FIG. 1. The untreated sheet showed a rapid initial yellowing followed by a slower phase that followed zero order kinetics as reported by Lebo (Ph.D. Thesis, Institute of Paper Chemistry, 1988). The formate (20% by weight) decreased this rapid initial yellowing and copper sulfate (80 ppm Cu on pulp) enhanced the effect still further. However, copper sulfate by itself actually increased the rate of yellowing. The increase in the light absorption coefficient after one-hour of light reversion was 2.6, 1.0, and 0.7 $m^2/kg$, respectively, for the untreated formate-treated, and formate plus copper sulfate-treated sheets.

Therefore, to further illustrate the synergism between sodium and calcium formate and other chemicals capable of quenching the superoxide anion, new sheets were made from another bleached CTMP. These sheets were treated with formate solution containing trace amounts of either copper sulfate or ascorbic acid, both of which have a high rate constant ($1.25 \times 10^6$ L/moles.s) for their reactions with superoxide anion. All of the solutions in this experiment were adjusted to pH 6. The results in Table IX clearly show the synergistic effects of formate and either copper sulfate or ascorbic acid. Ascorbic acid by itself (0.1% on pulp) had no effect on reversion.

TABLE IX

| | Sample | | | | |
|---|---|---|---|---|---|
| | 1 | 2 | 3 | 4 | 5 |
| Initial Light Absorption Coeff. (K) | 1.27 | 1.19 | 1.22 | 1.38 | 1.30 |
| Increase in K (2 h Light-Aging) | 2.81 | 1.61 | 0.86 | 1.18 | 1.48 |

Sample 1: Bleached CTMP
Sample 2: Bleached CTMP + 20% $NaHCO_2$ (solution)
Sample 3: Bleached CTMP + 20% $NaHCO_2$ + 80 ppm $Cu^{++}$
Sample 4: Bleached CTMP + 20% $NaHCO_2$ + 0.1% Ascorbic Acid
Sample 5: Bleached CTMP + 20% $Ca(HCO_2)_2$ + 80 ppm $Cu^{++}$

EXAMPLE 10

The same pulp sheets as described in Example 9 were treated with 20 weight percent of three other formyl compounds, hexyl formate, N,N-dibutylformamide and N-formylurea The compounds, with the exception of N-formylurea, are liquids with high boiling points. However, they are volatile at room temperature. Hexyl formate in duplicate experiments evaporated completely in 2.5 hours. All three compounds were dissolved in methanol and added uniformly to the sheets. Most of the methanol evaporated from the sheets in about 30 minutes. Methanol treatment of the sheets without formyl compounds had no effect on reversion. Table X shows the results of light-aging for Samples 2, 3 and 4, compared to the untreated Sample 1.

TABLE X

| | Sample | | | |
|---|---|---|---|---|
| | 1 | 2 | 3 | 4 |
| Initial Light Absorption Coeff. (K) | 1.27 | 1.24 | 1.20 | 1.27 |
| Increase in K (2 h Light-Aging) | 2.81 | 2.25 | 1.74 | 2.54 |

Sample 1: Bleached CTMP
Sample 2: Bleached CTMP + 20% hexyl formate
Sample 3: Bleached CTMP + 20% N,N-dibutylformamide
Sample 4: Bleached CTMP + 20% N-formylurea The foregoing examples can be repeated with similar success. From the foregoing description, one skilled in the art can easily ascertain the essential characteristics of this invention and, without departing from the spirit and scope thereof, can make various changes and modifications to the invention in order to adapt it to various usages and conditions.

Without further elaboration, it is believed one skilled in the art can, using the preceding description, utilize the present invention to its fullest extent. The above-mentioned embodiments are, therefore, to be construed as merely illustrative and not limitative of the remainder of the disclosure whatsoever.

What is claimed is:

1. A method for reducing brightness reversion of bleached pulps containing lignin comprising the steps of forming said pulps into a sheet, and treating said sheet with a compound other than forminc acid, said compound having formyl functionality of the type shown in FIG. I,

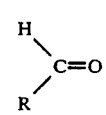

FIG. I wherein O is oxygen, C is carbon, H is hydrogen and R is any functional group having an element bonded to C, said element being selected from the group consisting of nitrogen and oxygen.

2. A method for reducing brightness reversion of pulps containing lignin for use as newsprint comprising the steps of forming said pulps into a sheet of newsprint paper, and treating said newsprint sheet with a compound other than formic acid, said compound having formyl functionality of the type shown in FIG.

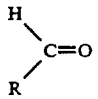

FIG. I wherein O is oxygen, C is carbon, H is hydrogen and R is any functional group having an element bonded to C, said element being selected from the group consisting of nitrogen and oxygen.

3. A method for reducing brightness reversion as recited in claims 1 or 2 wherein said sheet is further treated with calcium carbonate.

4. A method for reducing brightness reversion as recited in claims 1 or 2 wherein said sheet is further treated with a trace amount of superoxide anion quencher.

5. A method for reducing brightnes reversion as recited in claim 4 wherein said superoxide anion quencher is copper sulfate or ascorbic acid.

6. A method for reducing brightness reversion of bleached pulps containing lignin, comprising the steps of forming said pulps into a sheet, and treating said sheet with a compound selected from the group consisting of formate salts, formamides, formic acid esters and N formylurea.

7. A method for reducing brightness reversion of pulps containing lignin for use as newsprint comprising the steps of forming said pulp into a sheet of newsprint paper, and treating said sheet with a compound selected from the group consisting of formate salts, formamides, formic acid esters, and N-formylurea.

8. The method for reducing brightness reversion as recited in claims 6 or 7 wherein the formate salt is sodium formate, calcium formate, or magnesium formate.

9. The method for reducing brightness reversion as recited in claims 6 or 7 wherein the formamide is N,N-dibutylformamide.

10. The method for reducing brightness reversion as recited in claim 8 wherein said sheet is further treated with calcium carbonate.

11. The method for reducing brightness reversion as recited in claim 8 wherein said sheet is further treated with a trace amount of superoxide anion quencher.

12. The method of reducing brightness reversion as recited in claim 11 wherein the superoxide anion quencher is copper sulfate or ascorbic acid.

13. A sheet of paper comprising bleached pulps containing lignin, which pulps have been treated with a compound other than formic acid, said compound having formyl functionality of the type shown in FIG. I,

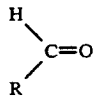

FIG. I[II]

wherein O is oxygen, C is carbon, H is hydrogen and R is any functional group having an element bonded to C, said element being selected from the group consisting of nitrogen and oxygen.

14. A sheet of paper comprising pulps containing lignin for use as newsprint, which pulps have been treated with a compound other then formic acid, said compound having formyl functionality of the type shown in FIG. I,

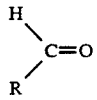

FIG. I[V]

wherein O is oxygen, C is carbon, H is hydrogen and R is any functional group having an element bonded to C, said element being selected from the group consisting of nitrogen and oxygen.

15. The sheet of paper as recited in claim 13 or 14 wherein said compound is selected from the group consisting of formate salts, formamides, formic acid esters and N-formylurea.

16. The sheet of paper as recited in claim 15 wherein the formate salt is sodium formate, calcium formate or magnesium formate.

17. The sheet of paper as recited in claim 15 wherein the formamide is N,N-dibutylformamide.

18. The sheet of paper as recited in claim 15 wherein the formic acid ester is hexyl formate.

19. The sheet of paper as recited in claim 16 wherein the sheet is further treated with calcium carbonate.

20. The sheet of paper as recited in claim 16 wherein the sheet is further treated with a superoxide anion quencher.

21. The sheet of paper as recited in claim 20 wherein the superoxide anion quencher is copper sulfate or ascorbic acid.

* * * * *

UNITED STATES PATENT AND TRADEMARK OFFICE

CERTIFICATE OF CORRECTION

PATENT NO. : 5,080,754

DATED : January 14, 1992

INVENTOR(S) : Francis et al.

It is certified that error appears in the above-identified patent and that said Letters Patent is hereby corrected as shown below:

Col. 12, line 60, delete "forminc" and insert in its place --formic--.

Column 13, line 30, delete "brightnes" and insert in its place --brightness--.

Column 13, line 38, delete "N" and insert in its place -- N- --.

Column 14, line 12, delete "FIG. I[II]" and insert in its place --FIG. I--.

Column 14, line 27, delete "FIG. I[V]" and insert in its place --FIG. I--.

Column 14, line 36, delete "claim" and insert in its place --claims--.

Column 3, line 35, delete "or" and insert in its place --on--.

Column 6, line 9, insert -- ) -- after "$(O_{2.}$-".

Signed and Sealed this

First Day of June, 1993

*Attest:*

Michael K. Kirk

MICHAEL K. KIRK

*Attesting Officer*

*Acting Commissioner of Patents and Trademarks*